United States Patent [19]

Nakamoto

[11] 4,143,961

[45] Mar. 13, 1979

[54] ELECTROPHOTOGRAPHIC DUPLICATION APPARATUS

[76] Inventor: Hiroo Nakamoto, 12-go, 9-ban, 3-chome, Wakazono, Kokura-Minami-ku, Kitakyushu-shi, Fukuoka-ken, Japan

[21] Appl. No.: 760,479

[22] Filed: Jan. 18, 1977

Related U.S. Application Data

[63] Continuation-in-part of Ser. No. 566,564, Apr. 9, 1975, abandoned.

[30] Foreign Application Priority Data

| | | | |
|---|---|---|---|
| Apr. 15, 1974 | [JP] | Japan | 49/42527 |
| Apr. 16, 1974 | [JP] | Japan | 49/42461 |
| May 18, 1974 | [JP] | Japan | 49/56667[U] |

[51] Int. Cl.[2] ..... G03G 15/04

[52] U.S. Cl. ..... 355/5; 355/8; 355/57; 355/59

[58] Field of Search ..... 355/3 R, 3 TR, 3 DD, 355/3 CH, 5, 8, 57, 58, 59, 11, 13; 118/657, 658

[56] References Cited

U.S. PATENT DOCUMENTS

| | | | |
|---|---|---|---|
| 3,040,704 | 6/1962 | Bliss | 118/658 |
| 3,117,884 | 1/1964 | Greig | 355/3 DD X |
| 3,237,516 | 3/1966 | Shearer et al. | 355/11 |
| 3,511,564 | 5/1970 | Gawin et al. | 355/5 X |
| 3,612,678 | 10/1971 | Haslam et al. | 355/11 X |
| 3,626,898 | 12/1971 | Gawron | 118/658 |
| 3,663,101 | 5/1972 | Von Grabe | 355/11 X |
| 3,709,603 | 1/1973 | Furuichi | 355/3 R X |
| 3,721,553 | 3/1973 | Giaimo | 355/3 R X |
| 3,764,804 | 10/1973 | Hirschman | 250/324 |
| 3,788,740 | 1/1974 | Shogren | 355/8 X |
| 3,832,055 | 8/1974 | Hamaker | 355/3 TR |
| 3,854,449 | 12/1974 | Davidson | 355/3 DD X |
| 3,879,121 | 4/1975 | Simpson | 355/3 TR |
| 3,881,446 | 5/1975 | Kurita et al. | 118/657 |
| 3,893,760 | 7/1975 | Thettu | 355/3 R |
| 4,007,986 | 2/1977 | Komori et al. | 355/8 X |

OTHER PUBLICATIONS

Culhane, M. B.; Gap Transfer of Toned Electrostatic Image, Defensive Publication, No. T869,004, Dec. 16, 1969.

Randolph, D. C.; Vibration Suppressor for Corona Wires, IBM Technical Disclosure Bulletin, vol. 14, No. 6, Nov. 1971, p. 1860.

*Primary Examiner*—Fred L. Braun

[57] ABSTRACT

In an electrophotographic apparatus, an image transmission system which is provided with a focusing light path, a duplication light path and a magnifying mechanism moves toward an original laying unit by scanning the image of an original section by section during a copying operation. One of the mirrors in the image transmission system rotates between a first position wherein it forms the focusing light path and a second position wherein it forms the duplication light path. During the copying operation, the original laying unit is also movable simultaneously in either same or opposite direction relative to the movement of the image transmission system so that an image of desired magnification rate and of accuracy is produced on a photosensitive element without requiring the lens of a long focal length.

6 Claims, 26 Drawing Figures

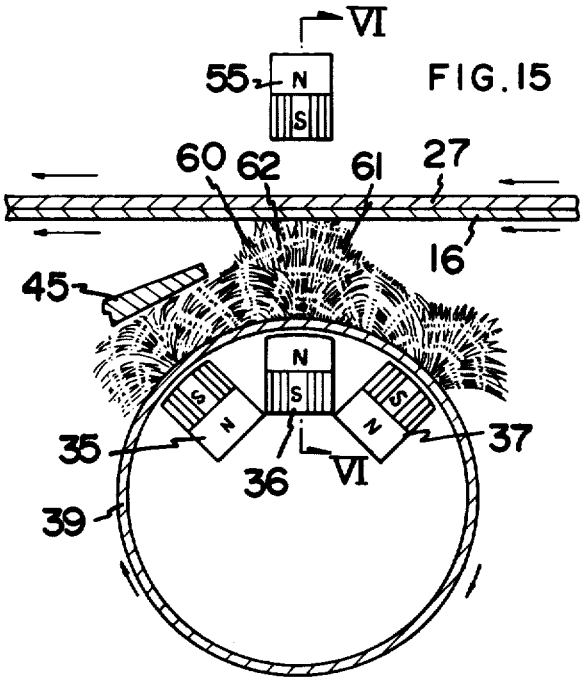
FIG. 15
FIG. 16
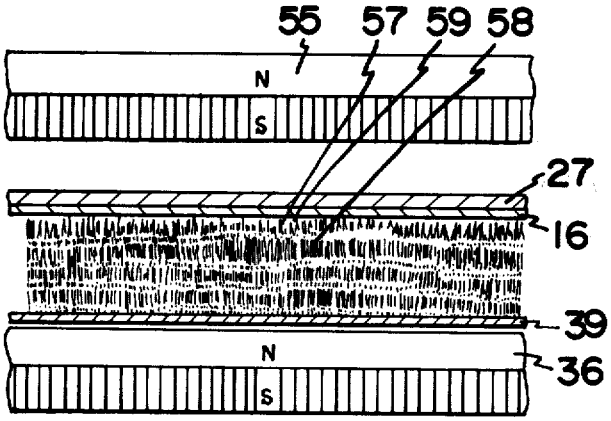
FIG. 17
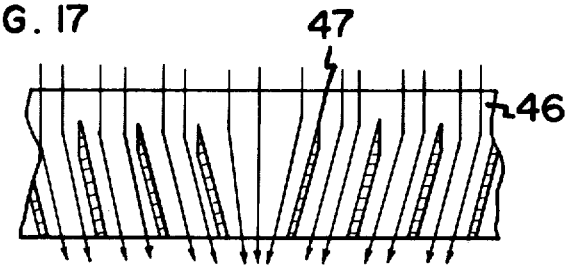

ELECTROPHOTOGRAPHIC DUPLICATION APPARATUS

This is a Continuation-in-Part application of Ser. No. 566,564 filed Apr. 9, 1975 now abandoned.

BACKGROUND OF THE INVENTION

The present invention relates to an electrophotographic duplication apparatus which employs a unique scanning method for duplicating operation.

Hitherto production of copies having different sizes from an original was limited to the case of producing smaller copies in only a limited number of reduced ratios because the apparatus involved was cumbersone and expensive. In order to obtain copies of the desired enlarged copies, there was only the method which comprises microphotograph-enlargement. However, this method requires much time and is expensive and very inconvenient and the size of the original to be copied has some limitation. Furthermore, in order to obtain copies of a size larger than the above described size, 1:1, copies were only obtainable from a single-faced original by a transmission-contact method. In this method, a light exposure system including magnifying means is large-sized and complicated and, consequently, the driving unit, photosensitive element, electrostatically charging unit, transferring unit and fixing unit for fixing transferred sheets also must be large-sized. Obtaining copies having this large size is difficult from the viewpoint of enlarging the known small-sized electrophotographic duplicating apparatus because more rigorous conditions are required for each unit and element. Consequently, it is difficult to use this method in a field where obtaining copies of original such as drawings or maps requires accuracy.

For example, when an original of DIN AO size (841mm × 1189mm) is copied by the above transmission-contact method where the original laying unit and the image transmission system including the magnifying (projecting) lens are both stationary with each other during the copying operation, the projecting lens must cover at least a diagonal line (about 1360mm) of the original for completing the desired copying operation so that the projecting lens having substantially a long focal length is required resulting in the duplicating apparatus of a large-sized construction. Futher, the conventional electrophotographic duplicating apparatus has the following other disadvantages.

(i) Photosensitive elements commonly used in electrophotography such as selenium or zinc oxide photosensitive element, and so on have the limitation that the surface of the element is very easily injured. Accordingly, it is necessary to rub the surface of the photosensitive element softly, slowly and uniformly at a suitable speed to improve the development of the images per unit of time and area. In order to develop the images, there has been a cascade process and a magnetic brush process. Until now there has not been any improvement in the brush process to provide excellent, uniform images, namely, in the device whereby latent images change into visible images, including the area where the photosensitive element contacts the developer.

(ii) In order to carry out charging and transferring by an electrophotographic apparatus, both ends of the corona wires are fixed and direct voltage is applied thereto and the surface of the photosensitive element is subjected to corona discharging. In such an arrangement where only the ends of the corona wires are supported, the application of electric voltage causes them to bend toward the surface of the photosensitive element causing vibration. Therefore, the distance between the surface of the photosensitive element and the corona wires can not be kept constant and this causes uneven charging and spark discharging sometimes occurs. This is the result of the fact that the corona wires are supported only at their ends.

(iii) In the electrostatic transfer method, in order to make a copy it is necessary that the entire transfer sheet be brought into contact with the entire surface of the photosensitive element. Images corresponding to the original are transferred to the transfer sheet by corona discharging on one side of the transfer sheet. However, the transfer sheet does not come in close contact with the surface of the photosensitive element because air gaps are formed between the surface of the photosensitive element and the transfer sheet due to the strain on the transfer sheet. Consequently, images corresponding to the original images can not be transferred. In order to prevent this defect, transfer sheets are packed previously in moisture-proof packaging. However, they are exposed to another atmosphere when the package is opened for use, and generating strain on the transfer sheet can not be prevented. Furthermore, in a conventional electrostatic duplication apparatus, which is a small-size copying apparatus for forming relatively small-sized copies such as B-4 or A-4 size, strain is not a problem because the transfer sheets used are small-sized. However, when using large-sized transfer sheets such as those greater than A-2 size, strain increases in proportion to the area and the resulting transfer images do not correspond to the original images.

Accordingly, it is an object of the present invention to provide an electrophotographic duplication apparatus which can resolve the above described defects, which is small-sized and in which the magnification or reduction ratio is changeable at will at the time of duplication.

It is another object of the present invention to provide an electrophotographic duplication apparatus which includes a unique combination of an original laying unit and an image transmission system wherein the image transmission system whih comprises a focusing light path, a duplication light path and a magnifying mechanism moves toward an original laying unit by scanning the image of an original layed on the above unit section by section and furthermore the original laying unit is also movable simultaneously in either same or opposite direction relative to the movement of the image transmission system so that an image of a desired magnification rate and of accuracy is produced on a photosensitive element without requiring the magnifying lens of a long focal length which is inevitable in a conventional electrophotographic duplication apparatus for copying the original having the considerable size such as DIN AO (841 mm × 1189 mm).

It is still another object of the present invention to provide an electrophotographic duplication apparatus by which uniform discharging is carried out by stretching a fine linear insulator across the corona wires to prevent vibration of the corona wires so as that the distance between the photosensitive element and the corona wires is constant.

A further object of the present invention is to provide a developing device which is characterized by heteropolar permanent magnet rods which are disposed adjacently with alternating polarities on a fixed non-magnetic axis having at least one blank area in which no magnet is placed between the magnet rods, a fixed permanent magnet rod disposed so that it faces the heteropolar permanent magnet rods with the opposed faces of the facing magnetic rods having a different polarity from each other, the development of images being carried out between the facing magnet rods by movement of a non-magnetic plate, the photosensitive element having a photoconductive layer, a developer and a non-magnetic plate. Furthermore, it is characterized by a guide plate which provides a suitable place in which the developer is able to move, whereby the developer is rubbed and agitated up and down and left and right.

A still further object of the present invention is to provide an apparatus in which transfer sheets are not subject to strain and are able to come into uniformly close contact with the surface of the photosensitive element.

A still further object of the present invention is to provide an electrophotographic duplication apparatus in which copies having the desired magnification or reduction ratio can be produced from an original such as large-sized original, small-sized original, stereographic original, sheet original, one-face printed original or both-face printed original, and so on.

BRIEF EXPLANATION OF DRAWINGS

FIG. 15 is a diagram which illustrates the state of the magnetic field in the developing device of the present invention.

FIG. 16 is a longitudinal section view of the line VI-VI of FIG. 15.

FIG. 17 is a plan view of a guide plate in the developing device.

DETAILED DESCRIPTION OF THE INVENTION

In the following, the present invention will be illustrated with reference to the appended drawings.

Figure 1:
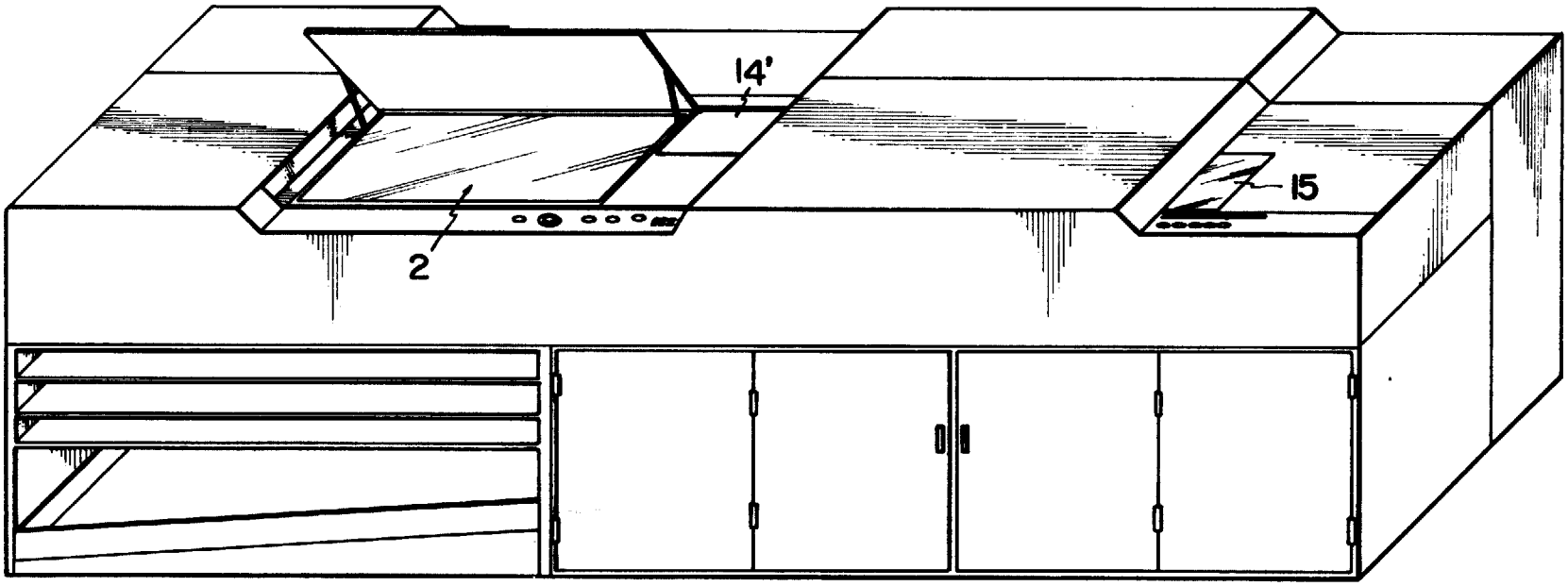
FIG. 1 is a perspective view of the electrophotographic duplication apparatus of the present invention.
Figure 2:
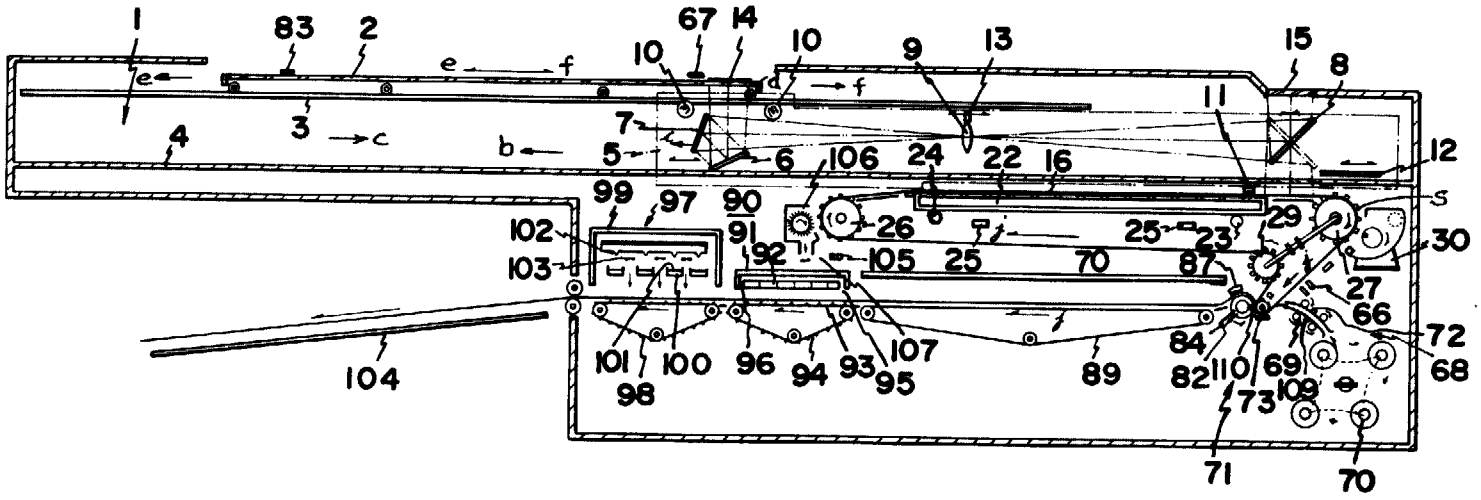
FIG. 2 is a schematic longitudinal sectional front view of the above apparatus.
Figure 3:
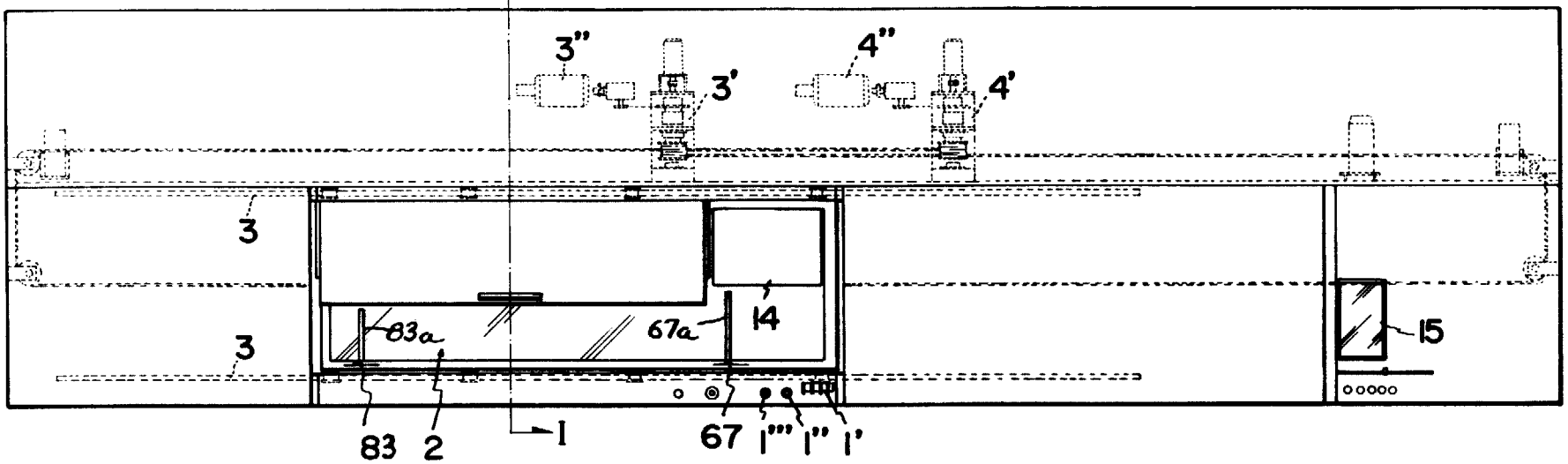
FIG. 3 is an enlarged partial plan view of the above apparatus showing the original laying unit and image transmission system in detail.
Figure 4:
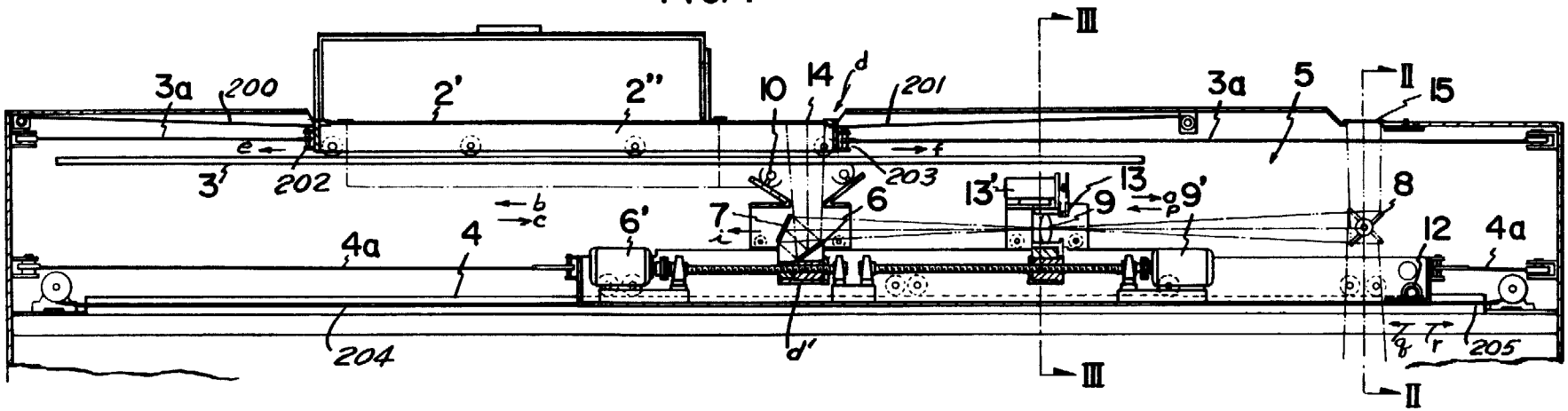
FIG. 4 is a side elevation view of the apparatus in FIG. 3.
Figure 5:
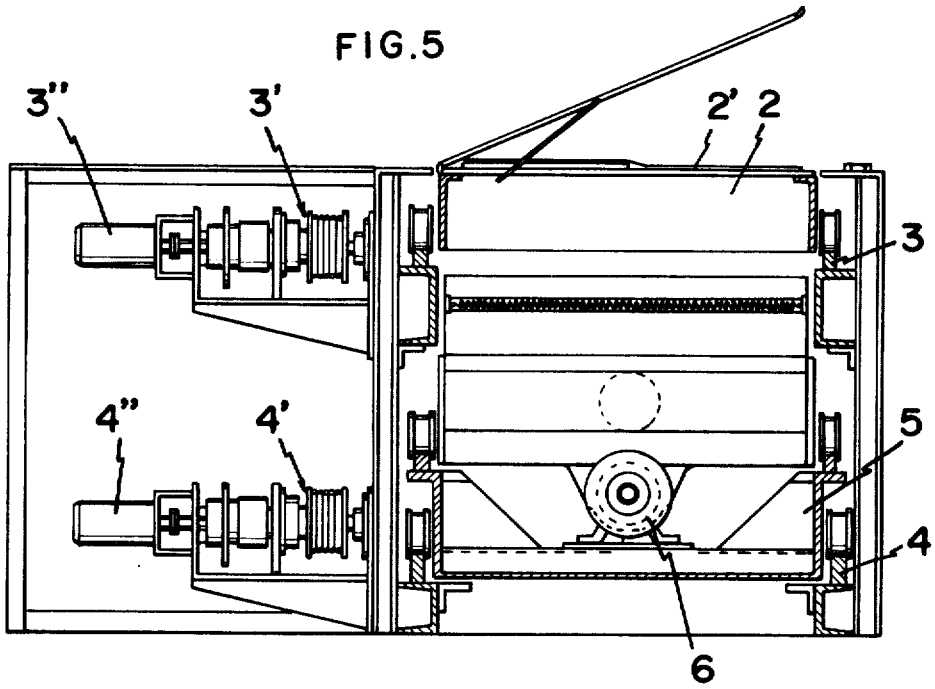
FIG. 5 is a transverse cross sectional view of FIG. 4 taken along the line I-I.
Figure 6:
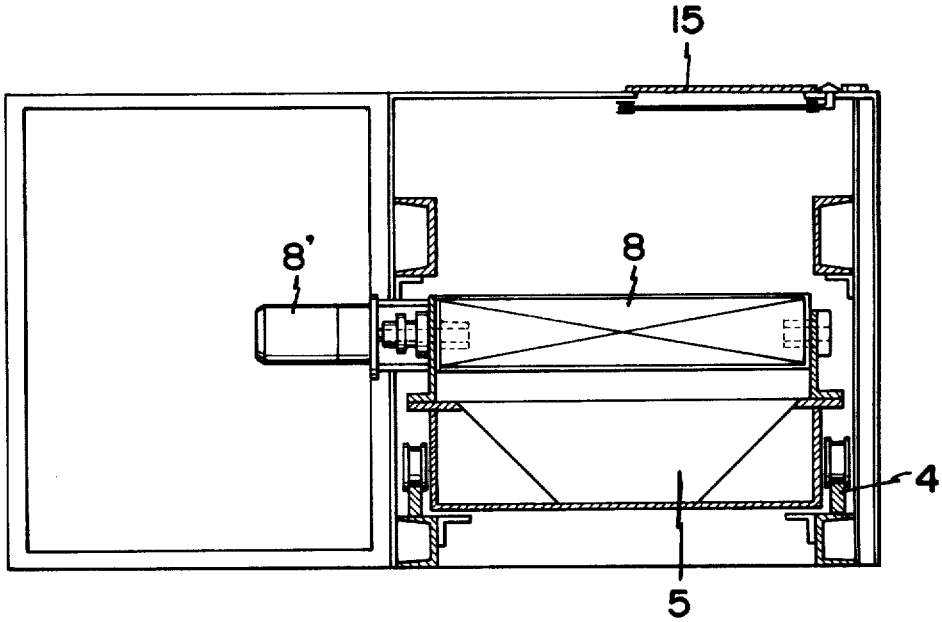
FIG. 6 is a transverse cross-sectional view of FIG. 4 taken along line II-II.
Figure 7:
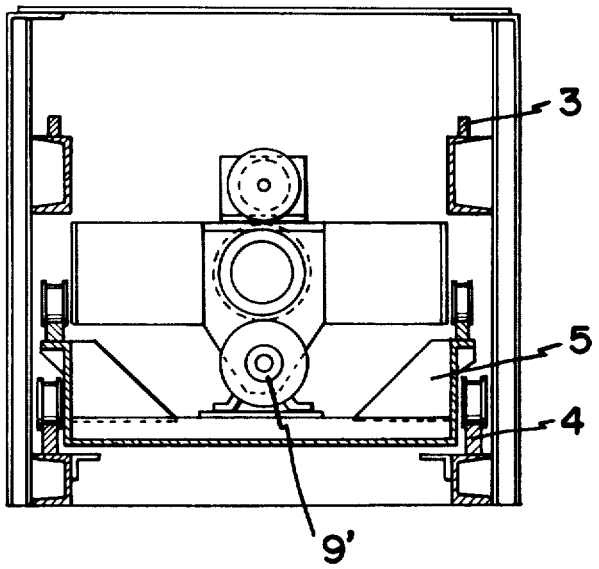
FIG. 7 is a transverse cross-sectional view of FIG. 4 taken along line III-III.

FIGS. 1 and 2 show the electrophotographic duplication apparatus according to the present invention, wherein a unit 2 for laying the original is positioned on the upper part of a body 1, a contact glass 2' having a size which corresponds to the possible largest size original to be copied is set in a desired frame 2" and provided on a slidable guide 3, and the unit 2 is slidable by means of a desired apparatus such as a winch means 3' which is activated by a power operated motor 3" so as to move the unit 2 longitudinally in either direction e or f by way of wires 3a. A movable image transmission system 5 is provided on a slidable guide 4 below unit 2 wherein 4' is a winch means which is activated by a power operated motor 4" so as to move the image transmission system 5 longitudinally in either direction b or c by way of wires 4a. The image transmission system 5 includes a duplication path and focusing-and-magnification check both of which use substantially the same optical path. This optical path is made of non-rotatable mirrors 6, 7, a notatable mirror 8 a projecting lens 9, light sources 10 for illuminating the original and a print chart 14 and a focusing-and-magnification check glass 15. If desired, the mirrors 6, 7 and 8 and the lens 9 are either rotatable polyhedrons or movable, and the angle of an optical path can be changed thereby to form either focusing-and-magnification paths or duplication path. Of course, it is possible to increase the number of mirrors or lenses. The mirrors 6 and 7 conduct the original image or the print chart image (the image such as numerals or letters printed on the print chart) to the projecting lens 9. The rotatable mirror 8 which turns preferably 90 degrees in the direction of the arrows g or h by a suitable known device is positioned so that an image of light from the projecting lens 9 is projected on the surface of the photosensitive element 16 or on the surface of the focusing-and-magnification check glass 15 alternatively.

Figure 8:
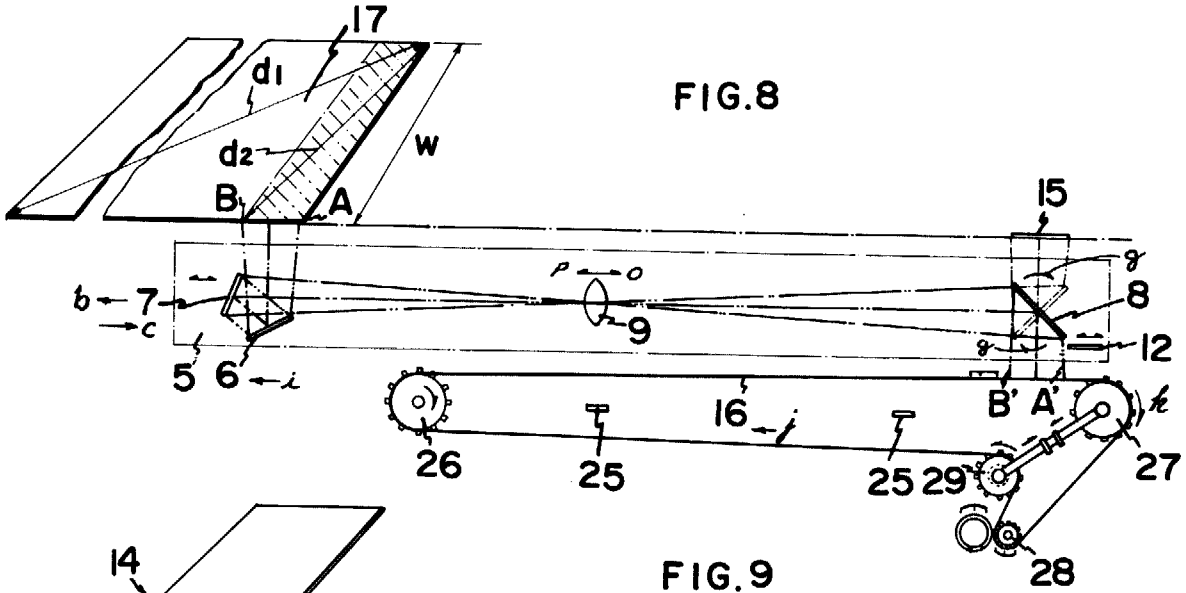
FIG. 8 is a diagram of a duplication light path.
Figure 9:
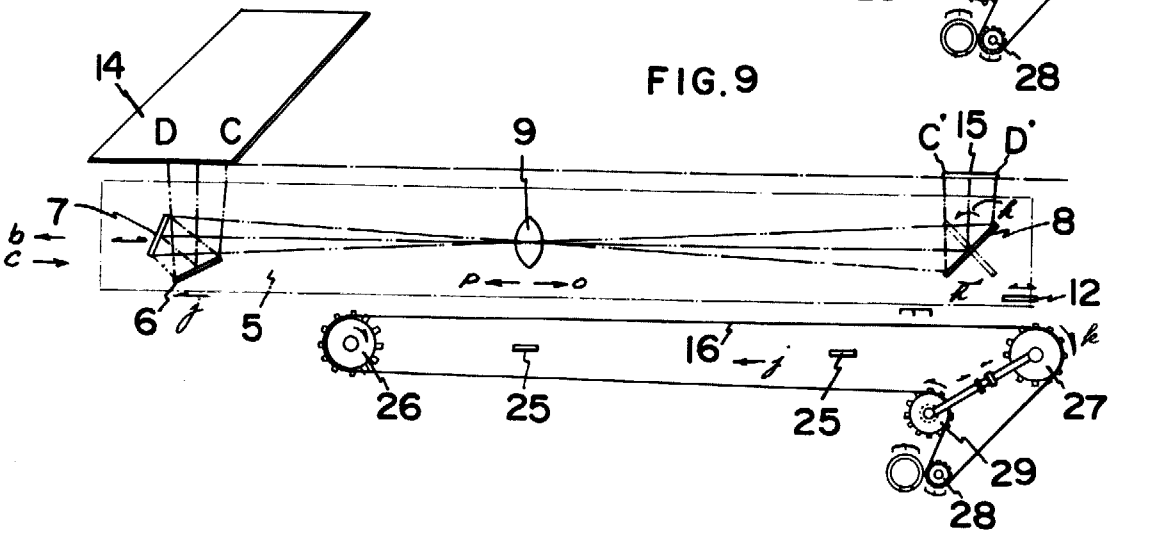
FIG. 9 is a diagram of a focusing light path.

In the following, optical paths are illustrated in more detail. The duplication path is shown in FIG. 8 and the focusing-and-magnification check path is shown in FIG. 9. In FIG. 8, a sectional image of an original 17 to be projected to the mirror 6 in a stationary state is in a range of A–B. This image is projected to the mirror 6 and then to the mirror 7. It is then projected through the lens 9 to the rotatable mirror 8 which is positioned to face the photosensitive element at the desired angle. Then it is projected as an ortho-image A'–B' to the surface of the photosensitive element 16; these stages compose the duplication path. In this case, position of the image does not change, because the right part A of the original 17 is projected as the right image A' on the surface of the photosensitive element 16 and the left part B of the original 17 projected as the left image B' on the surface of photosensitive element 16. The length of mirrors 6, 7 and 8 is greater than the width W of the original to be copied.

According to FIG. 9, the print chart 14 on which clear numerals or letters are printed to be used as control is positioned on the right end of the contact glass of unit 2 for laying the original, and an image of numerals or letters within C–D of the print chart 14 is projected to the mirror 6. It is then projected to the mirror 7 and projected through the lens 9 to the mirror 8 which is now rotated at a desired angle relative to the focus glass 15. Thus, the image is projected as an ortho-image D'–C' on the focusing-and-magnification check glass 15; these stages compose the focusing-and-magnification check path. Even though the inverse ortho-image is formed, since the image transmission system 5 is in a stationary state at this stage of operation, the image on the focusing-and-magnification check glass is readily viewable and there is no difficulty in checking whether the copy would be duplicated accurately on the photosensitive element at a desired magnification ratio if the copying operation is initiated. If necessary, the print chart 14 can be disposed on another place of the body together with light sources for illuminating the print chart 14 so as to be the same distance as that between the original 17 and the lens 9. The image transfer system 5 further comprises a motor means 6' such as a pulse motor for moving the mirrors 6 and 7 in a direction i along the body 1 and another motor means 9' for moving the projecting lens 9 in either direction o or p between the mirros 6 and 7 and the mirror 8 along the body 1. These mirrors 6, 7 and projecting lens 9 are to be moved for a fine adjustment of the magnification ratio and focusing.

When the magnification memory means 1' is manipulated by the operator turning the dial to the desired magnification ratio, and a starting switch 1" is pushed on, motor 6' and 9' are activated by a numerical control device or a mini computor (not shown in FIG. 1) so as to move the mirrors 6,7 and the lens 9 to suitable positions, respectively, so that the preparatory magnification ratio adjusting operation is completed. For accurately transferring the developed image of the original 17 on the contact glass 2' onto a transfer sheet 70, and original head indicator 67 and an orginal tail indicator 83 are provided on the contact glass 2'. Each indicator 67 or 83 has the elongated bar 67*a* or 83*a* which extends transversely just below the contact glass 2'. An original head indicator 67 is linked to the lenses 7 and 6 and moves simultaneously with the lenses 7 and 6 when the magnification or reduction ratio is adjusted. Linking of the indicator 67 is released when the image transmission system 5 slides. Thus, the original 17 is placed on the left side of this indicator 67. The original end indicator 83 is slidable and capable of coming into an alignment with the tail end of the original 17.

To be more specific, when the object mirrors 6 and 7 move longitudinally in the direction i for adjusting the magnification ratio, the original head indicator 67 moves in the same direction i and by the same distance as those of object mirrors 6 and 7 since they are linked with each other. After completing the above determination of the magnification ratio, the original head indicator 67 is disconnected automatically from the mirrors 6 and 7.

Subsequently, the original 17 to be copied is laid on the contact glass 2' of the original laying unit 2 such that the head of the original 17 is positioned at the left of the above original head indicator 67.

When the image transmission system 5 starts the longitudinal movement thereof in the direction b, the image of the black-colored bar 67*a* of the original head indicator 67 is first scanned and projected onto the photosensitive element 16 by way of the duplication path prior to the image of the original 17 and the latent image of the bar 67*a* of the above indicator 67 is formed on the element 16.

The above latent image is then developed at the developing zone (which is described later in great detail). This developed image is detected by a suitable detector 66 such as a photoconductive cell which in turn emits a signal to actuate rollers 69 which send a transfer sheet 70 from a rolled paper such that the head of the transfer sheet 70 and the head of the developed image of the original come into alignment with each other.

The original tail indicator 83 is slidably placed at the rear portion of the contact glass 2' of the original laying unit 2 for determing the tail end of the original 17 to be copied.

After the desired position of the original head indicator 67 is determined, the original is laid onto the original laying unit in the way described heretofore. Subsequently, the above original tail indicator 83 is manually slid like a cursor such that the tail indicator 83 comes in alignment with the tail line of the original.

Due to the above placement of the original tail indicator 83, when latent image of the bar 83*a* of the original tail indicator 83 is developed by the developing zone in the same manner as the original head indicator 67 and the original, the developed image of the bar 83*a* of the tail indicator 83 is detected by the detector 66 which in turn pulses a signal to actuate a high-speed cutter 109 for cutting the reeling-out transfer sheet 70 from a rolled paper such that the tail end of the image of original 17 comes in alignment with the cut-out end of the reeled-out transfer sheet 70 in the transfer zone.

The light sources 10 for illuminating the original 17 and the print chart 14 will illuminate the original 17 simultaneously with the sliding of the image transmission system 5. The intensity of the illumination of the light sources 10 can be changed suitably in conjunction with the magnification or reduction ratio, sliding of the image transmission system 5, sliding of the original laying unit 2 and sensitivity of the photosensitive element 16. Furthermore, as the light sources 10, any article such as a fluorescent lamp or a halogen lamp can be used if it uniformly illuminates the original. As has been described above, the adjustment of the magnification or reduction ratio can be carried out by movement of the lens 9 or the mirrors 6 and 7 into the desired, accurate position moving them all at the same time or separately by means of driving devices 6' or 9'. The mirror 6 and mirror 7 may be disposed as a body or separately. If desired, it is possible to carry out a more accurate adjustment of the position by checking the projected image on the focusing and magnification glass 15 and adjusting exactly the position of lens 9 or mirror 6 and 7 by the desired means. Furthermore, it is possible to accurately control the iris of the projecting lens 9 by means of a suitable drive device 13 simultaneously with the determination of the magnification or reduction ratio so that the automatic iris device 13' gives the same exposure to the photosensitive element 16 in conjunction with the magnification or reduction ratio. Furthermore, an iris plate 12 is movable in the direction of the arrows q or r corresponding to the density of the original 17 and thus the exposure can be adjusted to be uniform.

At the above first stage of the duplication operation, only the widthwise head section of the original image is projected onto the photosensitive element 16 at a desired magnification ratio as shown in FIG. 8. Therefore in this invention the image transmisson system 5 and the original laying unit 2 are constructed such that they are movable relatively with each other in a way described hereinafter for the purpose of copying the entire image of the original 17 by scanning the original image, section by section.

Namely after the determination of the magnification or reduction ratio, the image transmission system 5 moves to the left b and the images are scanned by light and projected in turn on the surface of the photosensitive element 16. In this case, the sliding speed of the image transmission system 5 may be definite regardless of the change of magnification ratio constructed such that it can slide at a varied speed. The original laying unit 2 also moves relative to the sliding of system 5 corresponding to the magnification ratio.

The manner in which the copy of varying size relative to the original 17 is obtained is hereinafter disclosed wherein:

(I) When a copy having a reduced size compared to the original, for example, half the size of the original is required, the memory means I' and the start switch I'' are manipulated so that the projecting lenses 9 and mirrors 6, 7 are moved to respective desirable positions whereby the focusing-and-magnification check glass 15 receives a strip like image which is half of the size of the letter described on the print chart 14.

After making sure that image of letters on the focus glass 15 is clear and accurately magnified at a predetermined ratio, mirror 8 is rotated 90° so that image of the original 17 is now projected onto photosensitive element 16. If the image of the letters projected onto the focusing-and-magnification check glass 15 are not clear and are not accurately magnififed, the lens 9 and the mirrors 6 and 7 are moved automatically or manually so as to provide the fine adjustment of the focusing and magnification. Then the start switch I''' is pushed on so as to cause the relative movement of the original laying unit 2 and the image transmission system 5 wherein the image transmission system 5 moves to the left b at a predetermined constant speed while the original laying unit 2 moves to the right f with the same speed so that the original 17 is scanned by light section by section and an image, which is half of the original 17 in size, is projected onto the upper layer of the photosensitive element 16 which is kept stationary throughout the above copying operation.

(2) When a copy having the same size as the original 17 is required, the memory means and the start button are manipulated in the same way as described above wherein the projecting lenses 9 and mirrors 6, 7 are moved to desirable positions whereby the mirror 8 and focusing-and-magnification check glass 15 receive a clear image which is equal to the size of letter described on the print chart 14. In this case, however, although when the main start button is bushed on, the image transmission system 5 moves to the left b while the original laying init 2 is kept stationary and thus an image of the same size as the original 17 to be copied, is projected onto the upper layer of photosensitive element 16.

(3) When a copy having an enlarged size compared to the original 17 is required, the same preparatory magnifying operation is conducted wherein the projecting lenses 9 and mirrors 6, 7 are moved to a desirable position respectively so that the mirror 8 and the check glass 15 receive the strip of enlarged image which is twice as large as the size of the letter described on the print chart 14. In this case, however, after the above operation, the image transmission system 5 moves to the left b and simultaneously the original laying unit 2 moves to the left b at half the speed of the transmission system so that an image which is twice as large as the original 17 to be copied, is projected onto the upper layer of photosensitive surface 16.

The following formula describes the relationship of the movement between the original laying unit 2 and the transmission system 5.

$$\text{speed of original laying unit} = \frac{\text{speed of image transmission system}}{\text{magnification or reduction ratio}} - \text{speed of image transmission system}$$

In the conventional transmission-contact method where the entire image of the original is projected and copied which is not provided with the relative movement of the original laying unit and the image transmission system, the projecting lens must cover the diagonal length "$d_1$", of the original as shown in FIG. 8 so that the projecting lens having the long focal length is required resulting in the large-sized construction of the duplicating apparatus.

In the above scanning method of this invention where the original is scanned section by section, the projecting lens of short focal length which can merely cover the diagonal length $d_2$ of the section of the original is sufficient for the copying operation resulting in the small-sized construction of the duplicating apparatus.

Furthermore, since the photosensitive element 16 is kept stationary, the photosensitive element can receive the clear and accurately magnified image.

When the transmission system moves, an electrodes charging electrode unit 11 which are set in a body of the system 5 moves ahead of the mirror 8 to apply electrostatic charges to the surface of the photosensitive element 16, and consequently, an ortho-latent image is formed on the surface of the photosensitive element 16 which is, at this stage of operation, stationary.

For example, when the photosensitive element 16 is composed of an n-type semiconductor, negative charging is carried out. The charging electrode unit 11 is composed of a case which has an opening facing the photosensitive element, the other faces and both ends of which are covered with a conductive metal which case is grounded. A plurality of corona wires 18 having a diameter of 0.04–0.1mm composed of fine tungsten wires is stretched in parallel between both ends of the case and 5000–7000V of D.C. voltage is applied thereto. Intervals of the corona wires 18 and the surface of the photosensitive element 16 are kept in the range of several mm to several tens mm.

It is preferable that the distance between the case face and the surface of the photosensitive element 16 is several mm larger than the distance between the corona wires 18 and the surface of the photosensitive element 16. The speed of movement of the electrode unit 11 has a relationship to the movement of unit 2 on which the original is laid and the magnification or reduction ratio and the focal length of the lens 9. As the diameter of the corona wires 18 decreases, corona generation intervals become smaller. It has been found that the corona generates at the inverval of 1.5mm–2mm when the diameter is 0.04mm and uniform charging can be ensured. These are the optimum conditions.

Figure 10:
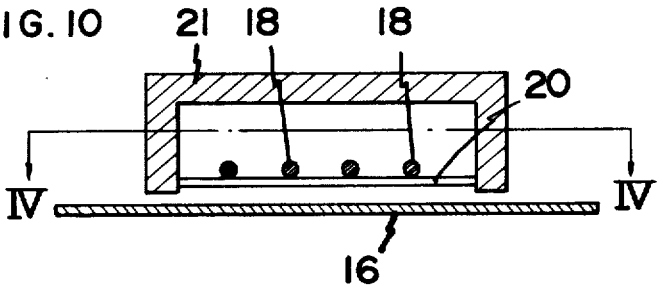
FIG. 10 is a diagram which illustrates a corona discharging process.
Figure 11:
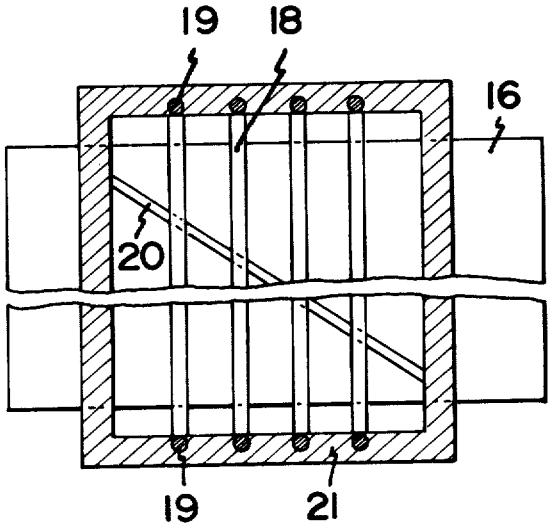
FIG. 11 is a transverse sectional sectional view taken along line IV-IV of FIG. 10.

In FIGS. 10 and 11, a fine linear insulator 20 such as a nylon filament of the type used for fishing is stretched obliquely across the corona wires, supporting and preventing vibration of the corona wires. The insulator 20 may be connected to a grounded cover 21 surrounding the corona wires 18, which is easily accomplished. By using the insulator, the interval between the surface of the photosensitive element 16 and the corona wires 18 can be maintained uniformly and consequently uniform charging and transcription can be carried out. Also discharging time becomes very short without increasing the number of the corona wires. Furthermore, it is unnecessary to increase the applied electric voltage to such a high value. In short, the corona wire of the present invention is very convenient because spark discharging can be prevented and the width of the discharging unit can be narrowed.

As the photosensitive element 16, an endless belt-shaped element is preferred. Furthermore, it is preferred that the base of the photosensitive element 16 be composed of a strong film such as polyester film and be used as a conveyor belt wherein both sides of the belt are perforated and suspended on a plurality of rolls as shown in FIG. 2. Further, a sheet of a photosensitive element may be put on the endless conveyor belt. A suction box 22 for maintaining the photosensitive element in a horizontal position is provided, 23 is a cam which rotates in the direction of the arrow by which the suction box 22 moves up and down as the photosensitive element 16 moves through a fulcrum 24 at the left end of the suction box and thus friction between the photosensitive element 16 and the suction box can be avoided, and 25 is a handle for removing or replacing rolls 26,27,28 and 29 and/or the suction box 22 and the cam 23 as a unit in order to replace a deteriorated photosensitive element 16. Tension of the photosensitive element can also be controlled by the roll 28.

In the following, the developing device will be illustrated with reference to FIG. 12.

Figure 12:
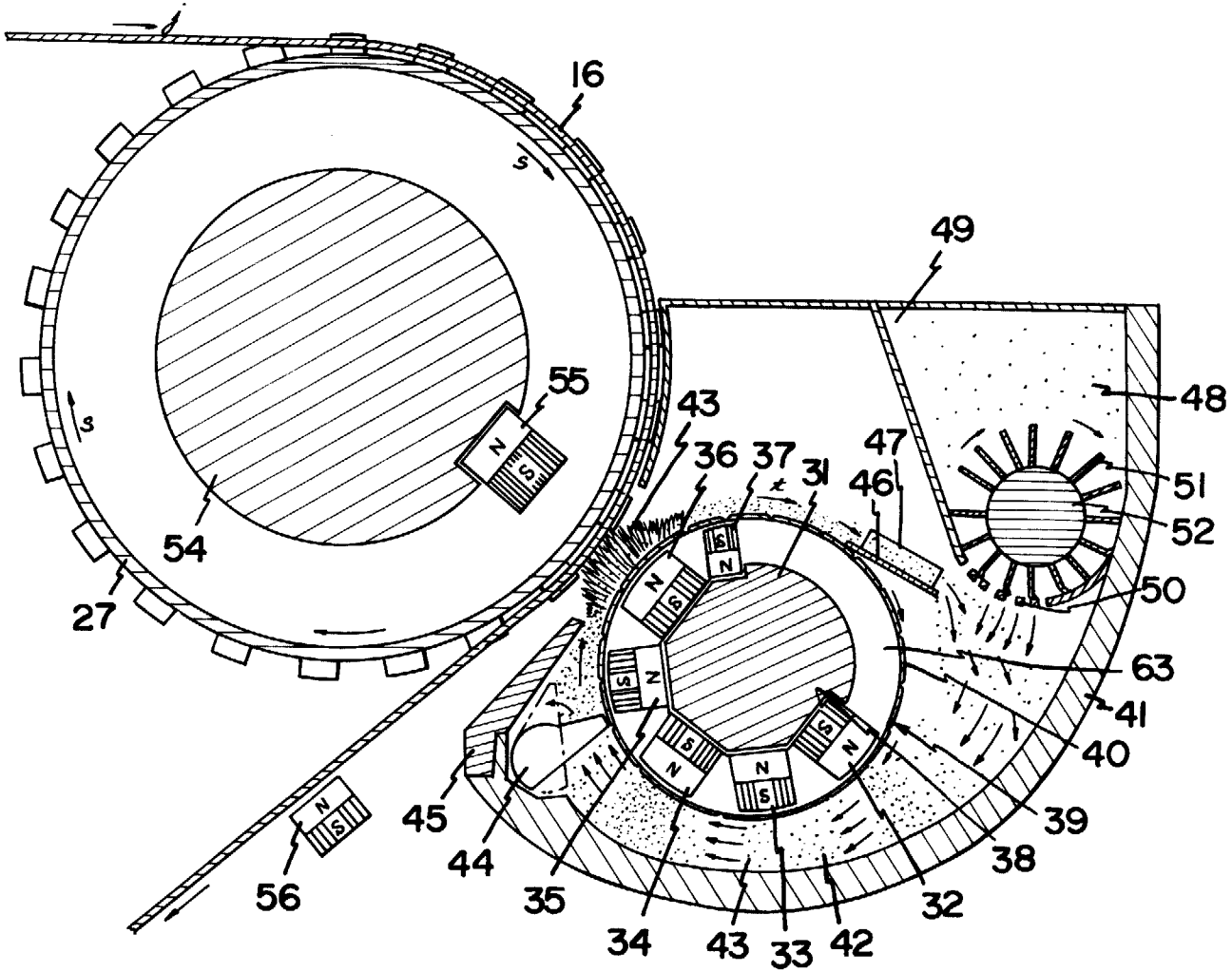
FIG. 12 is a diagram of a developing device.

FIG. 12 shows a sectional view of an example of the developing device 30 according to the present invention. In the developing device 30, permanent magnetic rods 32,33, 34,35,36 and 37 are set on a nonmagnetic fixed axis 31 through an iron plate 38 for increasing the magnetic force, wherein the polarity of the adjacent magnetic rods are opposite to each other. The outside faces of the magnet rods 32,33,34,35,36 and 37 are close to the inside of a surrounding nonmagnetic rotatable cylinder 39. The magnet rod 37 has a narrower width than the magnet rods 32,33,34,35 and 36. The magnet rod 36 has a broader width and has a higher magnetic force than the magnet rods 32,33,34,35 and 37. The rotatable cylinder 39 has a surface provided with ten-odd engraved grooves 40 which have a V-shaped cross section. The rotatable cylinder 39 is surrounded by an external panel 41 which is made of a nonmagnetic material. The space between the rotatable cylinder 39 and the external panel 41 forms a developer agitation chamber 42. The chamber 42 is filled with a definite amount of a developer 43 which was prepared by previously mixing a toner and a carrier. An operable nonmagnetic gate plate 44 is positioned on the outlet of the developer 43 and a nonmagnetic pushing plate 45 for charging a definite amount of the developer is positioned on the left of the gate plate 44. A non-magnetic guide plate 46 is placed in an upper right position relative to the rotatable cylinder 39 by which the developer 43 is separated from the rotatable cylinder 39 and introduced into the developer agitation chamber 42 in the direction of the arrows. The guide plate 46 is equipped with a guide 47 for discharging the developer to the right and left side. A toner tank 48 is positioned on the upper right side of plate 46 and guide 47. The toner 49 is accumulated in the tank 48. The bottom of the tank 48 forms a net 50 of fine meshes.

Flexible paddles 51 for discharging the toner are provided in contact with the net 50. In the toner tank 48 filled with the toner 49, about 0.4g of the toner is consumed for developing a sheet of size A-O(880mm × 1240mm). Since the amount of consumption of the toner 49 varies according to the type of the original, the rate of rotation of axis 52 is changeable by means of a suitable driving means so that the toner 49 is correctly supplied. The axis 52 is equipped with paddles 51 located in the toner tank 48 and the rate of rotation thereof is changeable. The paddles 51 are made of a nonmagnetic material. In FIG. 12, a nonmagnetic rotating drum 27 is shown which moves the photosensitive element 16 in the direction of the arrow J after the latent image is formed onto the photosensitive element. A fixed axis 54 in the rotatable drum 27 has a fixed permanent magnetic rod 55 in a suitable position thereof. The fixed permanent magnetic rod 55 and the permanent magnetic rod 36 have heteropolar surfaces facing each other. The magnetic rod 55 is placed opposite to the magnet rod 36. The rotatable drum 27, the photosensitive element 16, the developer 43 and the rotatable cylinder 39 are positioned in the space between the two magnetic rods 36 and 55. There is also provided a permanent magnetic rod 56 which is adjacent to the surface of the photosensitive element and can be removed. The magnet rod 56 removes the carrier which has adhered to the surface of the photosensitive element after the images are developed.

The photosensitive element 16 is electrostatically charged and exposed to light to form a latent image on the surface thereof in the above manner. Then it is carried in the direction of the arrow j in order to form a visible image on reaching the developing device 30. The rotatable cylinder 39 rotates in the direction of the arrow s synchronized with the movement of the photosensitive element 16. By the magnetic forces of the permanent magnetic rods 32,33,34,35,36 and the engraved grooves 40, the developer 43 moves in the direction of the arrows t and passes the front of the gate plate 44 which was opened synchronously in the direction of the arrows t and then the developer is discharged at the end of the pushing plate 45. Pushing plate 45 is sheet-shaped and its end is positioned on the middle of the magnetic poles of adjacent permanent magnetic rods 35 and 36 so that a definite amount of the developer can be discharged in a high density. The developer 43 falls down to the middle part of developing tank 42 where naps do not occur. However, it becomes nappy when it reaches the magnet rod 36.

Figure 13:
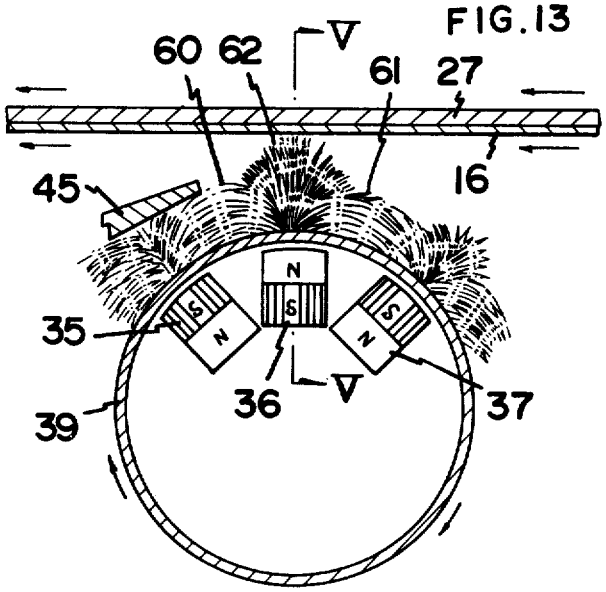
FIG. 13 is a diagram which illustrates the state of the magnetic field in the developing device of FIG. 12.
Figure 14:
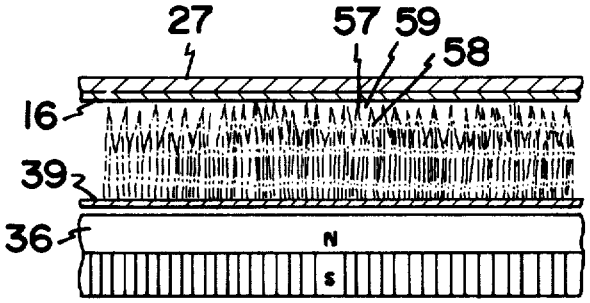
FIG. 14 is a longitudinal sectional view taken along line V-V of FIG. 13.

According to FIG. 13, the developer 43 which was discharged from a gap, for example, of 4mm between the pushing plate 45 and the rotatable cylinder 39 rises like a fan-shaped dry brush of 8mm height on the surface of the rotatable cylinder 39 over the permanent magnetic rod 36. This state is shown in FIG. 14, wherein the cross section of V—V is described. In order to compensate for valley areas 59 formed between brush ends 57 and 58, the rotatable cylinder 39 must be rotated faster, and deterioration of the photosensitive element 16 is accelerated, because the developer 43 is composed of a mixture of a toner 49 (e.g. carbon black) and a carrier (e.g. iorn) and acts like sand paper.

According to FIG. 15, if a permanent magnetic rod 55 is positioned so as to be opposite to a permanent magnetic rod 36 having a reverse polarity in an interference relationship with each magnetic force, the developer 43 discharged as 4mm of thickness, rises to 10mm in height on the surface of the rotatable cylinder 39 of the permanent magnetic rod 36. For example, developers 60 and 61 as shown in FIG. 13, rise towards the center of the magnetic pole of the magnetic rods 36 and 55 as shown in FIG. 15. The inside part 62 of the developers 60 and 61 rises also towards the center of the magnetic pole and thus the quantity of rising developer which has risen increases and the width of the developer becomes greater and the height thereof becomes 2mm greater.

The cross section of VI—VI in FIG. 15 is shown in FIG. 16. According to this figure, since the width of the developer which has risen becomes broader and the height thereof becomes higher and the number of brush ends increases, contact of the risen developer with the photosensitive element 16 per unit time and unit area is improved, namely, the contact is carried out effectively, uniformly and gently. Consequently, uniformly excellent development can be accomplished. Accordingly, life of the photosensitive element 16 can be prolonged because rotation of the rotatable cylinder 39 can be carried out at a lower speed and the distance between the surface of the photosensitive element 16 and the surface of the rotatable cylinder 39 can be greater.

In order to cause reliable adhesion of the toner to the latent images at the time of development, it is necessary that the toner and the carrier are previously agitated so as to have sufficient triboelectric charges. A definite amount of the developer 43 is previously charged into a mixing chamber 42. This chamber is suitable for continuously moving the developer 43 by means of the magnetic force of the adjacent heteropolar magnet rods and rotation of the rotatable cylinder. In order to push out the developer 43 in a definite amount at the end of the pushing plate 45, it is necessary that the mixing chamber be filled with a definite amount of the developer. Since the upper part of the developer layer moves on a larger definite orbit and the lower part moves on a smaller definite orbit, it is difficult to mix the developer 43 up and down and left and right. Therefore, it is necessary to temporarily separate the developer from the rotatable cylinder 39 to carry out homogeneous agitation.

The developer 43 which rubbed the surface of the photosensitive element 16 uniformly, gently and effectively reaches the position of the permanent magnetic 36, comes to the upper region of chamber 42 and is released from magnetic force in an area 63 where there is no magnetic rod provided between magnetic rod 37 and magnetic rod 32. Thus, the developer 43 is separated from the rotatable cylinder 39 by guide plates 46,47 and is discharged in the direction of the arrows towards a lower part of the mesh structure 50. The rate of movement of the developer 43 is accelerated by a push from developer following it forcing it through the guide plates 46,47.

According to FIG. 17, the developer 43 is guided and discharged in the direction of the arrows by means of guide plates 47 on the guide plate 46. The discharged developer comes into contact with a toner 49 which has fallen from the mesh structure 50 and mixes with it. It is possible to provide an agitation roll below the mesh structure. The developer 43 to which the toner 49 was supplied collides with a panel 41 and falls down towards the permanent magnetic rod 32. By this method sufficient mixing is carried out and this movement of the toner is repeated.

The toner 49 is very light and easily absorbs moisture and agglomerates. Further, it has the property of being easily adsorbed on the walls of developing unit 42. Therefore, it is hard for it to fall down naturally even though it is composed of very fine particles.

Figure 18:
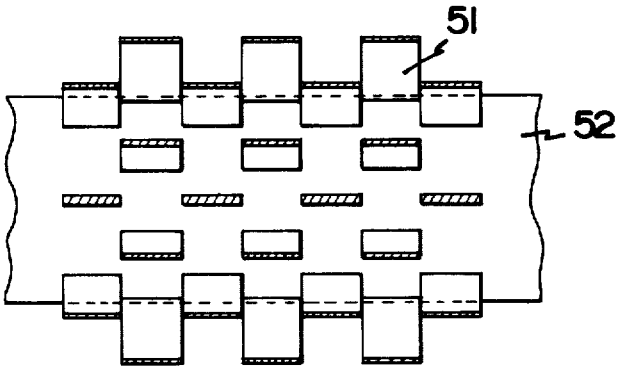
FIG. 18 is a plan view of paddles and a rotatable axis in a toner tank.

It is necessary to mix the toner 49 with finely divided carrier in order to prevent uneven development, when the toner is supplied. In FIG. 18, an axis rod 52 is equipped with flexible paddles 51. This axis rod rotates in contact with the fine mesh structure 50 to cause vibration and thus the toner 49 falls down from the mesh structure.

Figure 19:
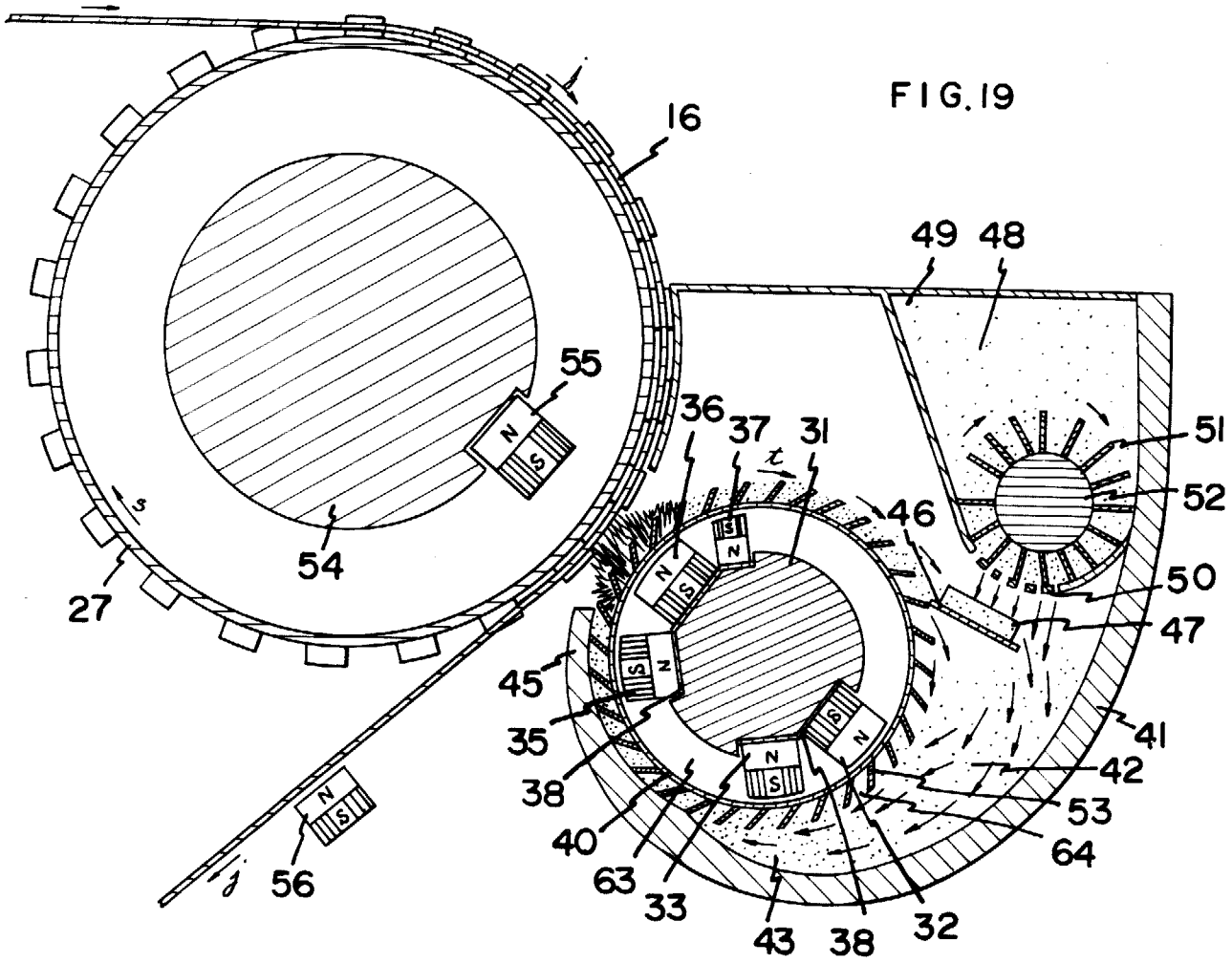
FIGS. 19 and 20 are each analogous to FIG. 12 but show modification.

FIG. 19 shows another example of the present invention. Namely, a rotatable cylinder 40 is equipped with nonmagnetic plates 53 to form buckets 64, wherein the top end of each plate closes with the pushing plate 45. The rotatable cylinder 40 has two areas where the permanent magnetic rod is non-existent. The developer 43 which has fallen moves in the direction of the arrows by means of a magnetic force from permanent magnetic rods 32 and 33 and the rotation of the rotatable cylinder 40 equipped with buckets whereby the developer gathers under the magnetic rod 33. The buckets 64 are then filled with the developer 43 and move towards the permanent magnetic rod 35. Since the state of the developer which has risen and the mixing operation of the developer are the same as described in FIGS. 13 to 18, detailed illustration of them is omitted here.

Figure 20:
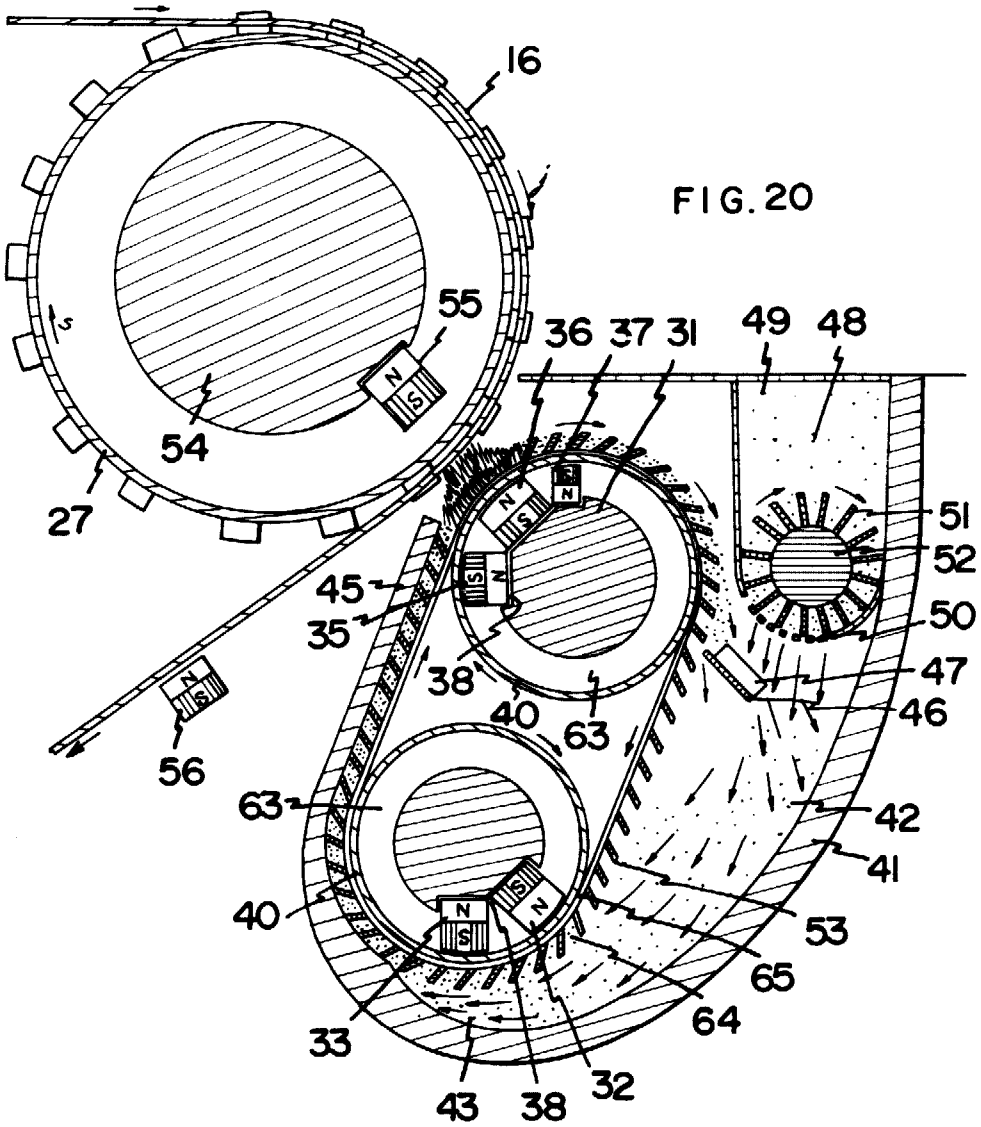

FIG. 20 shows another example of the present invention. Namely, rotatable cylinders 40 are disposed in an upper and lower position. A nonmagnetic endless belt 65 is equipped with nonmagnetic plates 53 which form buckets 64, wherein each top end of the nonmagnetic plates closes with a pushing plate 45. The endless belt 65 is suspended between the upper rotatable cylinder 40 and the lower rotatable cylinder 40 to form a conveyor belt equipped with buckets. Further, the rotatable cylinders 40 have each a space 63 where a permanent magnetic rod is non-existent. Since the state of developer and the mixing operation of the developer are the same as described in FIGS. 13 to 18, detailed illustration of them is omitted here.

According to the present invention, excellent developed images can be obtained and the life of the photosensitive element can be prolonged since napping of the developer per unit of time and area becomes greater and the surface of the photosensitive element can be rubbed uniformly, gently and effectively due to the fact that the developer rises like a brush between magnetic rods which are in such facing relationship as to have a different polarity. Further, uniform development can be carried out, because homogeneous mixing and rubbing are carried out by means of the guide plate in the area where the magnetic rod is non-existent.

The developing unit 30 can be exchanged for another developing unit, so that copies having another color can be produced. Furthermore, several developing units having different colors can be disposed in the body of the apparatus and can be exchanged by means of a desired system.

When the head end of the developed image of the originals reaches a detector 66, the developed image of the bar of the original head indicator 67 on the surface of the photosensitive element 16 is detected by the detector 66 which pulses a signal to cause rollers 69 in a paper supplying unit 68 to begin to rotate for sending out transfer sheet 70 on which the developed image is recorded.

In this example, the transfer sheets 70 are separated by size on plurality rolls. The transfer sheets 70 are sent out respectively to a transfer unit 71. It is possible for transfer sheets of a standard size to be accommodated in a case which can be disposed in a suitable position. The transfer sheet 70 is guided by guide plates 72 to the transfer portion 17 of the apparatus where the leading edge of the transfer sheet 70 coincides with the image of the original head indicator 67 developed on the surface of the photosensitive element 16. It is preferred that the transfer sheet 70 is superposed on the photosensitive element 16 outside a corona discharging area in the transfer section 17. If the transfer sheet 70 is superposed on the photosensitive element 16 within the corona discharging area, the sheet causes vibration just before contact, and consequently, the quality of the transcribed image deteriorates, because wave-like images parallel to the corona wires adhere to the background of the transcribed image. In the transfer section 17, corona wires are stretched the same way as in the charging unit 11. Since this part is nearly the same as the charging unit 11, detailed illustration is omitted here. Furthermore, it is preferable to stretch a few wires on the open face which wires obliquely cross the corona wires in order to prevent the sheet 70 from making contact with the transfer section 17.

When the transfer sheet 70 and the photosensitive element 16 are introduced into the transfer section 17 in the superposed state, visible powder images are on the surface of the transfer sheet because the powder images are subjected to corona discharging of a reverse polarity to the powder image at the back of the sheet 70. Thereafter the image transfer is accomplished by keeping the transfer sheet 70 in a semi-circular cylindrical shape, placing the surface of the transfer sheet 70 in contact with the surface of the photosensitive element 16 which has a photoconductive layer, carrying out corona discharging at the back of the transfer sheet 70, and placing the transfer sheet 70 into close contact with the surface of the photosensitive element over the whole contacting area, whereby images are transferred to the transfer sheet 70. Transfer sheets most commonly used such as high-grade paper or tracing paper contain moisture from the time of manufacture. Accordingly, the moisture content of the paper varies from one atmosphere to another before use because of partial removal or absorption of moisture and, consequently, strain, expansion or shrinkage of the paper occurs and a flat surface can not be maintained.

Figure 21:
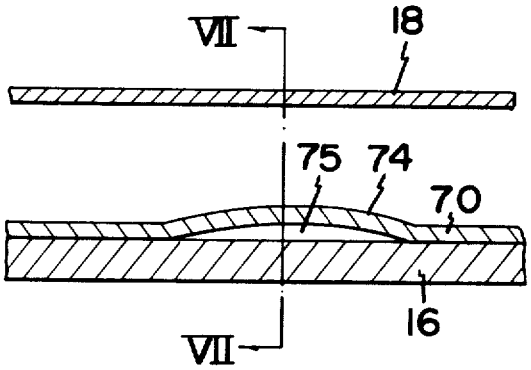
FIG. 21 is a view which shows the floating phenomenon of the transfer sheet which is a defect that occurs in the transfer region of a conventional apparatus.

According to FIG. 21, which is an enlarged sectional view of a transfer sheet 70 with partial strain is superposed on a photosensitive element 16 and corona discharging is applied at the back of the sheet 70 which in turn is pressed against and closely adhered to the surface of the photosensitive element by an electrostatic force.

Figure 22:
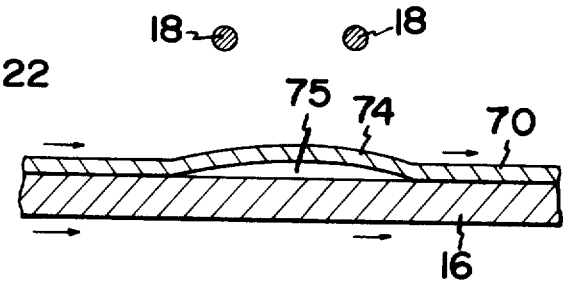
FIG. 22 is a cross-sectional view taken along line VII-VII of FIG. 21.

According to FIG. 22, which is an enlarged sectional view of VII—VII, an air gap 75 generated by strain on the sheet 70 does not permit the surface of the transfer sheet 70 and the photosensitive element to come into close contact over the entire surface area. Therefore the transfer of the image will be incomplete. However, the corona wires 18 force the surface of the entire sheet into close contact with photosensitive element 16 by electrostatic force causing complete contact and accomplishes the complete transfer of the image.

Figure 23:
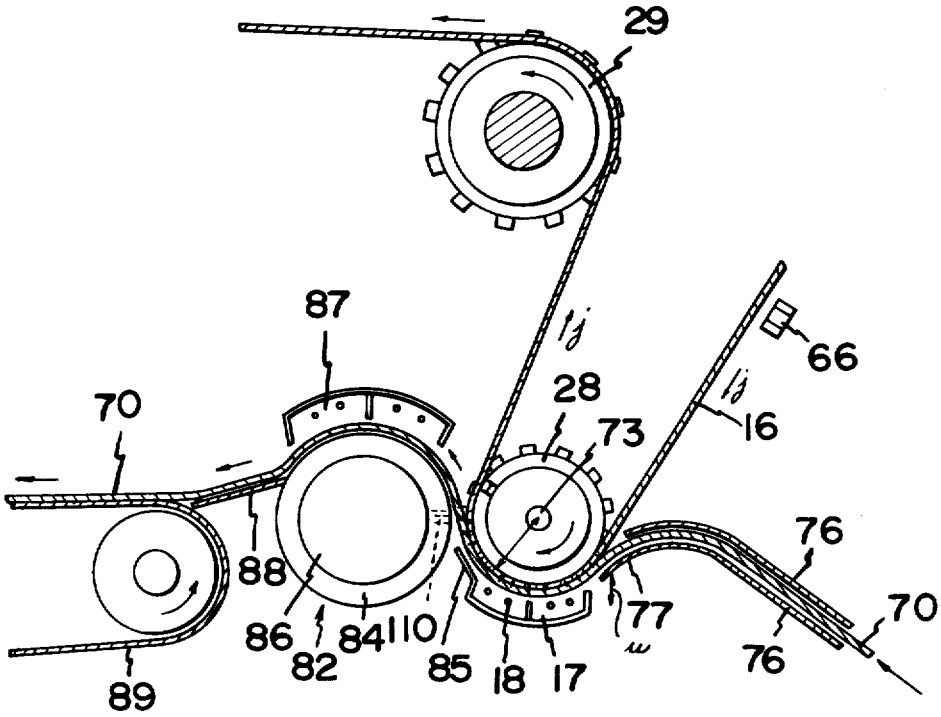
FIG. 23 is a diagram of a transfer portion and a separating portion of the apparatus.

FIG. 23 shows a cross section of an example of the present invention, wherein a photosensitive element 16 is movably provided along a rotatable cylinder 28 composed of a grounded nonmagnetic, conductive material. A transfer sheet 70 is sent out along upper and lower nonmagnetic guide plates 76 by means of a suitable driving device, synchronized with the movement of the photosensitive element at the outside of the corona discharging area and moves into the transfer area 17. At the same time, direct voltage is applied to corona wires 18 which are stretched on the transfer area 17, causing the transfer sheet 70 to be pressed against the photosensitive element 16 due to an electrostatic force. The visible toner images on the photosensitive element 16 are transferred to the sheet 70 and the movement of the sheet is caused by the rotatable cylinder 28 in the direction of the arrows. Strains disappear and the transfer sheet comes into close contact with the photosensitive element 16 over the whole contact area because the rotatable cylinder 28 has a radius R as small as possible, and the photosensitive element 16 and the transfer sheet 70 are kept in a semi-circular shape while moving. For example, when a semi-circular shape is formed by the photosensitive element 16 and the transfer sheet 70 along a rotatable cylinder having a 40mm radius, strains disappear even if tracing paper is used which is of 81.4 $g/m^2$ and is considerably strained after being allowed to stand for 3 minutes at 75% humidity in a flat state. Consequently, the photosensitive element and the paper are able to contact each other closely to form transfer images corresponding to the original images.

As the result of experiments, it was found that strain disappeared at a radius smaller than about 80mm in the case where high-grade paper of 64 $g/m^2$ was used and at a radius smaller than 60mm in the case where tracing paper of 81.4 $4/m^2$ was used. It has been found that the strain disappearance radius becomes larger as the thickness of the transfer sheet 70 increases and becomes smaller as the thickness of the sheet decreases. The end part of the lower guide plate 76 is equipped with a flexible thin plate 77 in a body, and the plate 77 allows latitude in sending out the transfer sheet 70. This plate is provided to prevent discrepancy of transfer images by upward or downward movement in the direction of the two-headed arrow u. A few corona wires 18 are stretched on an arc of a concentric circle around the rotatable cylinder 28 having an axis 73.

Figure 24:
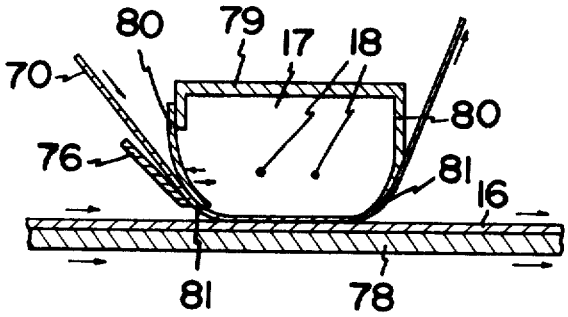
FIG. 24 is view which shows a modification of the transfer portion of the apparatus.

It is preferred that the distances between the surface of the photosensitive element 16 and corona wires 18 are identical to each other. FIG. 24 shows a cross section of another example of the present invention, wherein a photosensitive element 16 is superposed on a grounded, nonmagnetic, conductive plate 78, and a transfer device 17 is disposed in an upper position. The nonmagnetic, conductive plate 78 and the photosensitive element 16 move in the direction of the arrow j and a transfer sheet 70 is carried from the left side along a guide plate 76 and synchronized with the movement of the photosensitive element 16. When the end of the sheet 70 is separated from the photosensitive element 16 by, for example, a suction means, the sheet 70 is conveyed in the direction of the arrow n, maintaining a semi-circular shape. Thus strains disappear and as similarly described in FIG. 23, transfer images corresponding to the original images can be formed, because the transfer sheet 70 comes into close contact with the photosensitive element 16. In this case, the width of the transfer case 79 becomes small as there is a decrease in the number of corona wires 18, and thus the radius 73 of the rotatable cylinder 28 can be decreased.

Furthermore, transfer can also be carried out by moving the transfer device 17 equipped with a guide plate 76 without movements of the nonmagnetic, conductive plate 78, the photosensitive element 16 and the transfer sheet 70. The lower end 81 of both side plates 80 of the transfer case 79 has an arc shaped structure, by means of which the transfer sheet 70 can easily maintain a semi-circular state with a small radius.

As described above, the transfer sheet closely contacts the photosensitive element in the whole contact area and transfer images corresponding to original images can be obtained by a simple mechanism notwithstanding large or small strains of the transfer sheet, since the transfer sheet is maintained in a semi-circular shape at the time of transfer. Particularly, transfer on large sized paper can be easily and surely carried out.

The photosensitive element 16 and the transfer sheet 70 reach a separating area 82 while in an electrostatically attracted state. Further, a high speed cutter 109 of the paper supplying section 68 is operated by a signal pulsed from the detector 66 which pulses the signal when it detects the developed image of the original tail indicator 83 which corresponds to the developed image of the tail of the original on the photosensitive element 16 and cuts the transfer sheet in turn. In FIG. 23, a rotatable cylinder 84 having opening 110 formed as a line running the length of the cylinder is disposed near rotatable cylinder 28 which has a smaller radius than rotatable cylinder 84 in the separating area 82.

Figure 25:
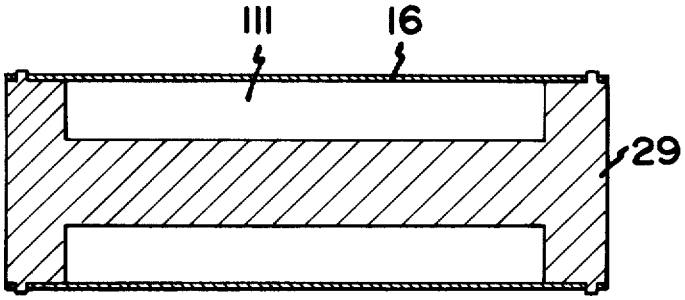
FIG. 25 is a transverse sectional view of a roll.
Figure 26:
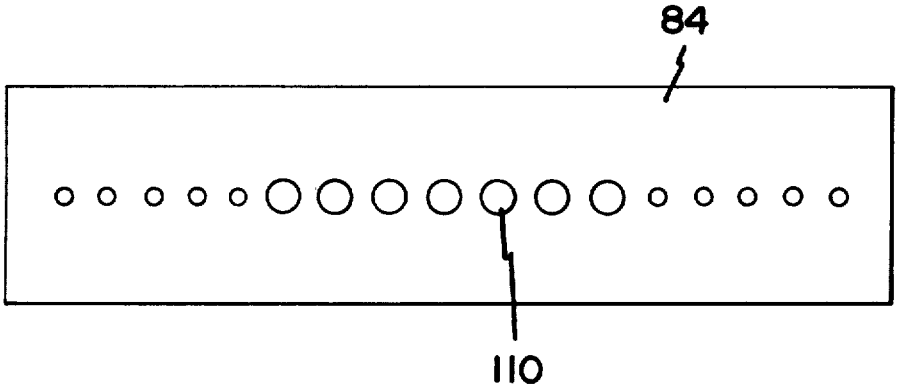
FIG. 26 is a plan view of a rotatable cylinder.

The photosensitive element 16 and the transfer sheet 70 pass through a space between cylinder 84 and cylinder 28. A roll 29 changing the course of the photosensitive element 16 is disposed at an acute angle in order to control the tension of the photosensitive element 16 on the cylinder 28. The transfer sheet 70 draws near the rotatable cylinder 84, passing over guide plate 85, and it is separated from the photosensitive element 16. When the leading end of the transfer sheet 70 coincides with openings 110 of the rotatable cylinder 84 at the position H, the sheet 70 is removed at the position H to cause separation of the sheet from the photosensitive element 16. The cylinder 84 has a hollow space 86 where air from suction flows, by which the transfer sheet 70 is separated when it passes the position H. In FIG. 25, the roll 29 has a hollow portion 111 so that it does not contact the surface of the photosensitive element 16.

Electrodes 87 for removing charge are positioned over the upper part of the cylinder 84. Corona discharging at a reverse polarity is applied by means of electrodes 87 to remove residual electrostatic charges on the transfer sheet 70. At the same time, the transfer sheet 70 is pushed against the cylinder 84 by a corona discharge force to ensure conveying of the sheet 70 in the direction of the arrows.

The transfer sheet is then conveyed by a guide plate to a conveyor belt 89 and reaches a fixing area 90. In the fixing area 90, the toner is melted by heat or is dissolved by the vapor of an organic solvent and fixed onto the transfer sheet 70. For example, in the heat fixing region 91, a transfer sheet conveying belt 93 is provided below an upper heater 92. Needles 94 project from the surface of the belt 93 to support the transfer sheet 70 by point contact. The transfer sheet 70 is supported so that it does not make contact with the high temperature heating member. In the fixing region 91, heaters 92 each have a different temperature, that is, the temperature increases gradually towards the center from an inlet 95 and decreases gradually towards an outlet 96. The conveying distance is comparatively long in order not to cause strain on the transfer sheet due to heat. Further, the temperature of heaters 92 is controllable so that they carry out the desired fixation according to the type of transfer sheet used. However, applying heat to the paper to be recorded on, that is, to the transfer sheet of high-grade paper, tracing paper or a polyester film or the like causes strain and expansion, and it is not suitable for forming minute drawings. Therefore, a vapor fixing area 97 is provided next to the heat fixing region 91, where an organic solvent is used.

It is necessary to properly use these fixing regions according to the desired purpose. In the case that area 97 is used, the heaters 92 in area 91 are not used but the conveyor belt 93 is operated. In the case that area 91 is used, the vapor fixing region 97 is not used but the conveyor belt 98 is operated.

It is possible to use both of these regions 91 and 97 at the same time. For example, the vapor fixing region 97 is disposed in an airtight casing 99 and a conveyor belt 98 made of a metal which is not corroded by organic solvents is movably suspended on rollers. An evaporation device having conveyor belt 98 is disposed over the heater 100 and the dishes 101. Further, fans 103 for agitating the vapor of the organic solvent in the casing 99 are provided in the upper part of the casing 99.

The lowering device 102 has a means by which the degree of lowering is controllable. The speed of the conveyor belt 98 and the speed of the conveyor belt 93 in the heat fixing region may be identical to or different from each other and the speed thereof is controllable. The visible images are fixed by being passed through a fixing area 90 and the sheet is then laid on a copy stacker 104.

After the transfer process, the photosensitive element 16 is uniformly exposed to light 105 or subjected to reverse charging to remove residual electrostatic charges and residual images on the surface thereof, and then it is passed through a fatigue recovery area 107 where the surface of the photosensitive element is cleaned gently by a cleaning brush 106, returning the photosensitive element to its initial state.

It is possible to dispose the above described developing device 30 between the illumination unit 105 or a reverse electric charging unit and the cleaning brush 106, and the mixing chamber 42 of the device 30 may be filled with only a finely divided carrier to form another cleaning brush. Of course, the toner tank 48 is not necessary in this case. The residual toner 49 on the surface of the photosensitive element 16 may be removed by rubbing slowly with light pressure to assist the subsequent cleaning by the cleaning brush 106.

The photosensitive element is composed of the highly sensitized pigment, zinc oxide, which deteriorates on excessive exposure to light which in turn may cause further deterioration of the photosensitive element itself.

Further, the image transmission system, the lens, the mirrors, the photosensitive element, the developing area, the transfer sheet supplying area, the fixing region, the cleaning brush and the conveyor belts are synchronized with each other by means of suitable driving devices.

Of course, prevention of vibration must be sufficiently considered.

What we claim is:

1. In a compact electrophotographic duplication apparatus comprising:

(a) a housing body;

(b) a unit on said body for receiving an original document to be copied in a horizontal plane, said unit comprising a transparent contact glass on which said original document is directly placed and a print chart containing indicia;

(c) first drive means for slidably moving said unit back and forth in said housing body along a first straight line path;

(d) a focusing-and-magnification check glass mounted on said housing body in view of the operator of the duplicating apparatus;

(e) means defining a photosensitive surface in said housing body;

(f) an image transmission system in said housing body operable to project a first image of said original document and said print chart and form a second image of said original document and said print chart, said second image being of a size equal to or different from said first image, said image transmission system comprising:

(i) a first mirror means underlying said unit for reflecting a first image of said print chart and said original document, (ii) a second mirror means for receiving the last said reflected image from said first mirror means as a second image, (iii) a projection lens disposed between said first mirror means and said second mirror means for determining the magnification ratio of said second image relative to said first image of said print chart and said original document image, and (iv) said second mirror means being rotatable to a first rotatable position to transmit said print chart image onto said focusing-and-magnification check glass through said first mirror means, said projection lens, and said second mirror means and to a second rotatable position to transmit the reflected original document image onto said photosensitive surface through said first mirror means, said projection lens and second mirror means; and (g) second drive means for slidably moving said image transmission system on said housing body along a second straight line path, said second straight line path being parallel to said first straight line path such that scanning of the original document is effected by said image transmission system as relative movement is effected between said unit and said image transmission system, whereby when said second mirror means is in said first rotatable position, a magnification-focusing light path is established between said print chart and said focusing-and-magnification check glass for providing a visual indication of the second image, and when said second mirror means is in said second rotatable position, a magnification-duplication light path is established between said transparent contact glass and said photosensitive surface for transmitting the second image onto said photosensitive element, said mangification-focusing light path having the same optical light path length as said magnification-duplication light path and said photosensitive surface being maintained stationary during said transmission of said second image onto said photosensitive surface.

2. In a compact electrophotographic duplicating apparatus according to claim 1, wherein said image transmission system further comprises means for moving said first mirror means relative to said projection lens.

3. In a compact electrophotographic duplicating apparatus according to claim 1, wherein said projecting lens comprises an iris means for adjusting the intensity of the light passing therethrough.

4. In a compact electrophotographic duplicating apparatus according to claim 1, wherein said image transmission system further comprises light means providing light on the scanned portion of said original document image and on said print chart.

5. In a compact electrophotographic duplicating apparatus according to claim 1, wherein said unit comprises an original document head indicator and an original document tail indicator slidably mounted on said contact glass, said original document head and tail indicators being alignable with the top and bottom edge of said original document placed on said contact glass, said image transmission system transmitting images of said original document head and tail indicators as latent images to said photosensitive surface.

6. In a compact electrophotographic duplicating apparatus according to claim 5 further comprising a sheet transfer device for feeding a transfer sheet on which the image on the photosensitive surface is reproduced and developing means for developing the image on the photosensitive surface and reproducing the image on the transfer sheet, said sheet transfer device comprising:

means for reeling out a rolled transfer sheet;

a cutter means for cutting a portion of the reeled out transfer sheet; and a detecting means for detecting the developed latent image on said transfer sheet and actuating said cutter means to cut said portion of said reeled out transfer sheet corresponding to the length of the original document as determined by the distance between said head and tail indicators.

* * * * *